United States Patent [19]

Mittmann

[11] 4,456,423

[45] Jun. 26, 1984

[54] SIDE CHANNEL BLOWER

[75] Inventor: Bernd Mittmann, Munich, Fed. Rep. of Germany

[73] Assignee: Webasto-Werk W. Baier GmbH & Co., Gauting, Fed. Rep. of Germany

[21] Appl. No.: 423,431

[22] Filed: Sep. 24, 1982

[30] Foreign Application Priority Data

Nov. 11, 1981 [DE] Fed. Rep. of Germany ..... 3144787

[51] Int. Cl.[3] ..... F04D 29/66

[52] U.S. Cl. ..... 415/53 R; 415/53 T; 415/119; 415/213 T

[58] Field of Search ..... 415/53 R, 53 T, 119, 415/213 T, 140, 141; 417/312

[56] References Cited

U.S. PATENT DOCUMENTS

| | | | |
|---|---|---|---|
| 2,869,670 | 1/1959 | Hoffman | 417/312 UX |
| 3,476,051 | 11/1969 | Skinner | 415/213 T UX |
| 3,545,890 | 12/1970 | Hubbard et al. | 415/53 T |
| 3,713,758 | 1/1970 | Nakayama | 417/312 |
| 3,734,638 | 5/1973 | Ebsary | 415/213 T X |
| 3,951,567 | 4/1976 | Rohs | 415/119 |
| 4,155,221 | 5/1979 | Dhoore et al. | 415/119 X |
| 4,412,781 | 11/1983 | Abe et al. | 415/53 T X |

FOREIGN PATENT DOCUMENTS

| | | | |
|---|---|---|---|
| 902074 | 1/1954 | Fed. Rep. of Germany . | |
| 1828192 | 3/1961 | Fed. Rep. of Germany . | |
| 1579792 | 3/1980 | Fed. Rep. of Germany | 415/53 T |
| 1373463 | 8/1964 | France . | |
| 165795 | 12/1981 | Japan | 415/53 T |
| 1496781 | 1/1978 | United Kingdom | 415/53 T |
| 370369 | 4/1973 | U.S.S.R. | 415/53 T |

*Primary Examiner*—Stephen Marcus
*Assistant Examiner*—Joseph M. Pitko
*Attorney, Agent, or Firm*—Antonelli, Terry & Wands

[57] ABSTRACT

A side channel blower, especially for use as a combustion air blower in vehicle heaters, with a blower housing comprising at least one side channel, into which one intake opening and one exhaust opening terminate, as well as with a blower wheel disposed in the immediate vicinity of the side channel and provided with a plurality of blades. In order to reduce the noise emission of the blower, at least that edge of the intake opening, which lies to the rear in the rotational direction of the blower wheel, is made elastic.

4 Claims, 4 Drawing Figures

SIDE CHANNEL BLOWER

BACKGROUND AND SUMMARY OF THE INVENTION

The invention relates to a side channel blower, especially for use as a combustion air blower in vehicle heaters, with a blower housing forming at least one side channel, in which one intake opening and one exhaust opening terminate, as well as with a blower wheel provided with a plurality of blades disposed immediately adjacent to the side channel.

Such blowers are known to have the disadvantage of developing a considerable amount of noise. In order to combat this, the installation chamber of the blower has been lined with noise-absorbing material or large volume intake mufflers. These measures are costly, however, and require a great deal of space, if the noise is to be reduced to a tolerable level, e.g., a value of approximately 60 dB(A) or less.

A principle object of the invention, therefore, is to provide a side channel blower with reduced noise emission.

This object is achieved according to a preferred embodiment of the invention by virture of the fact that at least the edge of the intake opening, which is located rearward in the rotational direction of the blower wheel, is made elastic.

To explain the source of the noise generation problem and the manner in which the present invention reduces same, the process by which gas, e.g., air, is delivered by a blade chamber located between two blades of the blower wheel during one complete revolution of this wheel will now be described. Firstly, the blade chamber draws in the gas at the intake opening. Pressure is generated in the blade chamber and, as soon as the blade chamber reaches to outlet opening, gas is released through this opening. However, during its movement from the intake opening to the exhaust opening, the blade chamber is always under pressure. Thus, when the leading edge, in the rotational direction, of the blade chamber reaches the rear edge of the intake opening, in the rotational direction of the blower wheel, gas suddenly escapes from the blade chamber under pressure. This produces a pressure pulse which enters the environment. This process is repeated for each individual blade. The resultant pressure pulse train is the basic reason for the disturbing noise generation. The measure according to the present invention gradually reduces the pressure in the individual blade chambers as these chambers move toward the outlet opening by virtue of deflection of the elastic trailing edge. This is because the gas can escape from the blade chamber with less of an impact, so that the pressure decline in the blade chamber is produced gradually instead. In this way, the compression impacts upon the environment are considerably reduced.

The elastic edge of the intake opening may be formed in an especially simple fashion from a plate of elastic material inserted in the blower housing. In particular, the plate can be made of sponge rubber, soft foam rubber, or a thin piece of sheet metal mounted partially on the blower housing.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
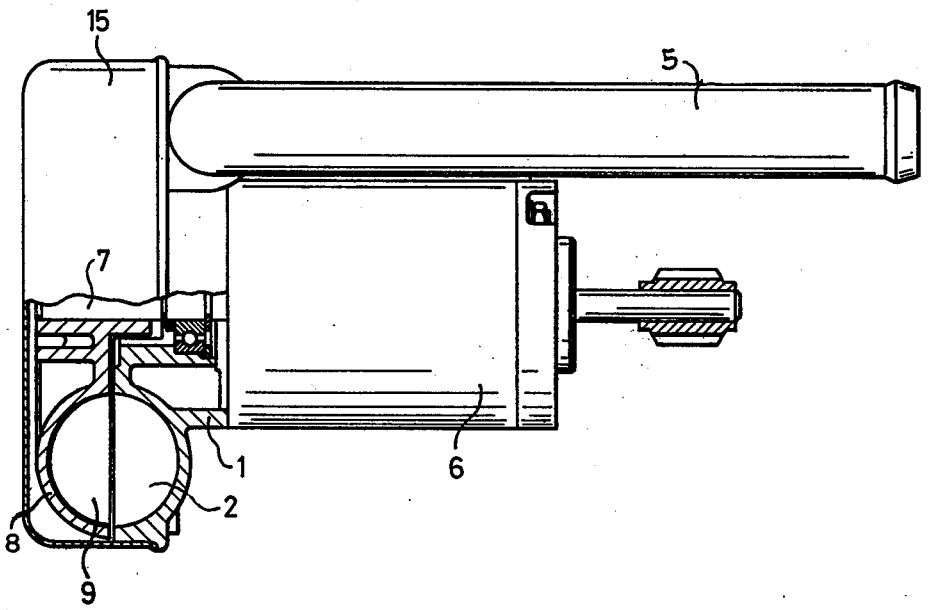
FIG. 1 is a partially cut away side view of a side channel blower according to the invention, including the drive motor.
Figure 2:
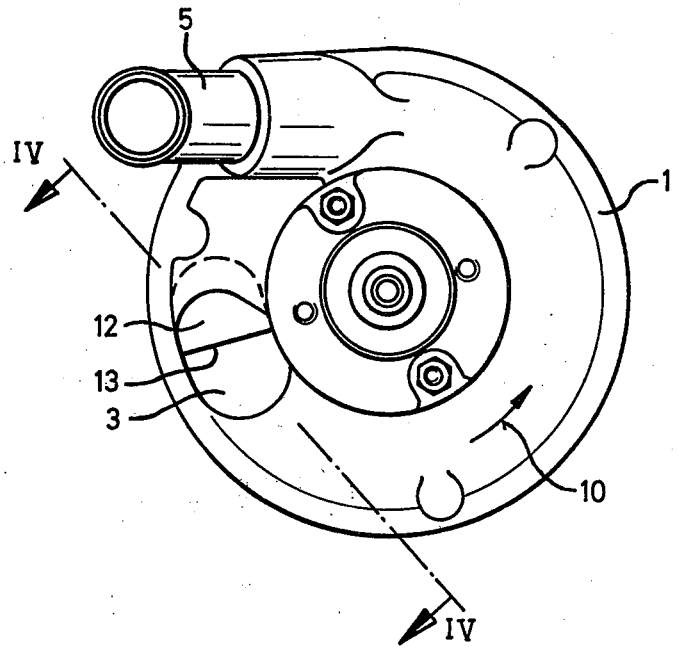
FIG. 2 is a top view of the device shown in FIG. 1, from the right side in FIG. 1.
Figure 3:
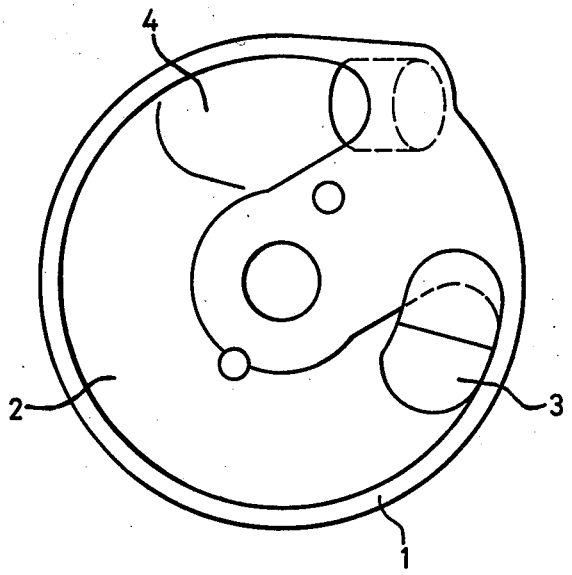
FIG. 3 is a view of the blower housing, looking at the end of the housing which faces the blower wheel.

The side channel blower comprises a blower housing 1, which forms an annular side channel 2. Side channel 2 communicates with an intake opening 3 and an exhaust opening 4. An exhaust stub 5 communicates with exhaust opening 4. A drive motor 6 is mounted to a rim or flange of blower housing 1, said motor having a blower wheel 8 on its drive shaft 7. Blower wheel 8 is provided, in known fashion, with a series of blades 9, distributed uniformly and circumferentially around blower wheel 8 and located opposite side channel 2.

Figure 4:
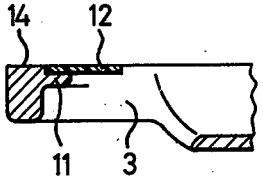
FIG. 4 is a partial section along line IV—IV in FIG. 2.

Blower housing 1 is provided with a shoulder 11 in the vicinity of the edge of intake opening 3, which is located rearward in the rotational direction (arrow 10) of blower wheel 8. A small plate 12, preferably made of sponge rubber or soft foam rubber, is fastened to shoulder 11, e.g., by gluing. Plate 12 thus forms that edge 13 of intake opening 3 which is located to the rear in the rotational direction of blower wheel 8. Instead of a sponge rubber or foam rubber plate, a thin piece of sheet metal may also be used, mounted partially on blower housing 1. The side of plate 12, which is at the top in FIG. 4, is flush with the end 14 of blower housing 1 which faces blower wheel 8. Rotatable blower wheel 8 is covered by means of a cap 15 mounted on blower housing 1.

During operation of the above-described side channel blower, plate 12 prevents an abrupt escape of the air from the blade chamber as it approaches edge 13, since elastic edge 13 deforms so as to present a certain degree of opening prior to the passage of blade 9. Consequently, the pressure prevailing in the blade chamber is more gradually reduced than with a rigid edge 13, and the resultant compression impact is considerably reduced. For example, measurements have shown that, when the known rigid edge is replaced by the elastic edge according to the invention, an output noise level of 85 dB(A) is reduced by 6 dB(A) to 79 dB(A), all other conditions being equal. On the basis of this simple and inexpensive solution, additional noise-reducing measures can be considerably reduced in order to produce an acceptable noise level.

It has been found that the measure proposed hereinabove is especially effective when the elastically designed edge 13 of intake opening 3 is made flush with the edge of the blower wheel blade which faces the intake opening, which is just reaching the intake opening at that time. Therefore, for example, if the blade edges extend along radial lines through the axis of rotation of blower wheel 8, elastic edge 13 will also preferably run in this direction.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A side channel blower, especially of the type for use as a combustion air blower in vehicle heaters, comprising a blower housing forming at least one side channel, an intake opening and an exhaust opening terminating in said side channel, and a blower wheel disposed in the immediate vicinity of the side channel and provided with a plurality of blades defining individual blade chambers, wherein at least the upstream edge of the intake opening, in the rotational direction of the blower wheel, is formed of a material that elastically deforms in a manner so as to gradually reduce the pressure in each blade chamber by deflection of said edge as each chamber moves toward said intake opening.

2. A side channel blower according to claim 1, wherein the elastic edge of said intake opening is formed by a small plate of elastic material which is mounted in the blower housing.

3. A side channel blower according to claim 2, wherein the small plate is made of a material from the group consisting of sponge rubber, soft foam rubber, and a flexible thin piece of sheet metal, mounted partially on the blower housing.

4. A side channel blower according to claim 1 or 2 or 3, wherein the elastic edge of the intake opening is aligned to be flush with an edge of the blower wheel blade, which faces the intake opening, when it is at a position just reaching the intake opening.

* * * * *